US007432859B2

(12) United States Patent
Zinanti et al.

(10) Patent No.: US 7,432,859 B2
(45) Date of Patent: Oct. 7, 2008

(54) MULTI-BAND OMNI DIRECTIONAL ANTENNA

(75) Inventors: Michael Zinanti, Wheat Ridge, CO (US); Shanmuganthan Suganthan, Watford (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 58 days.

(21) Appl. No.: 11/217,760

(22) Filed: Sep. 1, 2005

(65) Prior Publication Data

US 2006/0017622 A1 Jan. 26, 2006

(51) Int. Cl.
*H01Q 1/38* (2006.01)

(52) U.S. Cl. ..... 343/700 MS

(58) Field of Classification Search ..... 343/700 MS, 343/702, 795, 790–793, 803, 804, 891
See application file for complete search history.

(56) References Cited

U.S. PATENT DOCUMENTS

| | | | | |
|---|---|---|---|---|
| 5,559,523 | A * | 9/1996 | Smith et al. | 343/795 |
| 5,945,383 | A * | 8/1999 | Hunt | 505/329 |
| 6,337,667 | B1 * | 1/2002 | Ayala et al. | 343/795 |
| 6,404,394 | B1 * | 6/2002 | Hill | 343/702 |
| 6,529,171 | B1 | 3/2003 | Le Balier et al. | |
| 6,624,793 | B1 * | 9/2003 | Su et al. | 343/795 |
| 6,639,564 | B2 * | 10/2003 | Johnson | 343/702 |
| 6,765,539 | B1 | 7/2004 | Wang et al. | |
| 6,847,329 | B2 | 1/2005 | Ikegaya et al. | |
| 6,961,028 | B2 | 11/2005 | Joy et al. | |
| 7,027,005 | B1 | 4/2006 | Chien | |
| 7,034,769 | B2 * | 4/2006 | Surducan et al. | 343/793 |
| 2002/0190912 | A1 * | 12/2002 | Lebaric et al. | 343/795 |
| 2003/0231139 | A1 | 12/2003 | Tai et al. | |
| 2004/0183728 | A1 | 9/2004 | Zinanti et al. | |
| 2004/0196191 | A1 | 10/2004 | Hung et al. | |
| 2004/0263391 | A1 | 12/2004 | He et al. | |
| 2006/0033666 | A1 | 2/2006 | Su et al. | |
| 2006/0055615 | A1 | 3/2006 | Zhou | |
| 2006/0061514 | A1 | 3/2006 | Chien | |
| 2006/0208956 | A1 * | 9/2006 | Surducan et al. | 343/795 |

FOREIGN PATENT DOCUMENTS

| | | | |
|---|---|---|---|
| EP | 1 414 109 | A2 | 10/2003 |
| JP | 2002280817 | A | 9/2002 |
| TW | 519309 | | 1/2003 |
| TW | 523963 | | 3/2003 |
| WO | WO 02/095875 | A1 | 11/2002 |

OTHER PUBLICATIONS

International Bureau "Notification Concerning Transmittal of Copy of International Preliminary Report on Patentability (Chapter I of the Patent Cooperation Treaty)" dated Oct. 6, 2005 and "Written Opinion of the International Searching Authority" dated Nov. 4, 2004.
Search Report for Patent Application ROC (Taiwan) Patent Application No. 093107565; Nov. 22, 2007.

* cited by examiner

*Primary Examiner*—Huedung Mancuso
(74) *Attorney, Agent, or Firm*—Holland & Hart LLP

(57) ABSTRACT

The present invention provides a printed circuit board omni directional antenna. The omni directional antenna includes power dissipation elements. The power dissipation elements reduces the impact the power feed to the radiating elements has on the omni directional antenna's radiation pattern.

6 Claims, 2 Drawing Sheets

MULTI-BAND OMNI DIRECTIONAL ANTENNA

CROSS REFERENCE TO RELATED APPLICATIONS

This application claims the benefit of U.S. Provisional Patent Application Ser. No. 60/456,764, filed Mar. 21, 2003, titled Multi-Band Omni Directional Antenna, incorporated herein by reference.

BACKGROUND OF INVENTION

Omni directional antennas are useful for a variety of wireless communication devices because the radiation pattern allows for good transmission and reception from a mobile unit. Currently, printed circuit board omni directional antennas are not widely used because of various drawbacks in the antenna device. In particular, cable power feeds to conventional omni directional antennas tend to alter the antenna impedance and radiation pattern, which reduces the benefits of having the omni directional antenna.

Thus, it would be desirous to develop a printed circuit board omni directional antenna device having a power feed that does not significantly alter the antenna impedance or radiation pattern

FIELD OF THE INVENTION

The present invention relates to antenna devices for communication and data transmissions and, more particularly, to a multi-band omni directional antenna with reduced current on outer jacket of the coaxial feed.

SUMMARY OF INVENTION

To attain the advantages and in accordance with the purpose of the invention, as embodied and broadly described herein, an omni directional antenna is provided. The omni directional antenna includes a radiation portion and a power feed portion. The radiation portion includes a plurality of radiating elements. The power feed portion includes at least one power dissipation element. The at least one power dissipation element is coupled to a ground such that the impact on the antenna radiation pattern from the power feed is reduced.

The foregoing and other features, utilities and advantages of the invention will be apparent from the following more particular description of a preferred embodiment of the invention as illustrated in the accompanying drawings.

BRIEF DESCRIPTION OF DRAWINGS

The accompanying drawings, which are incorporated in and constitute a part of this specification, illustrate embodiments of the present invention, and together with the description, serve to explain the principles thereof. Like items in the drawings may be referred to using the same numerical reference.

DETAILED DESCRIPTION

Figure 1:
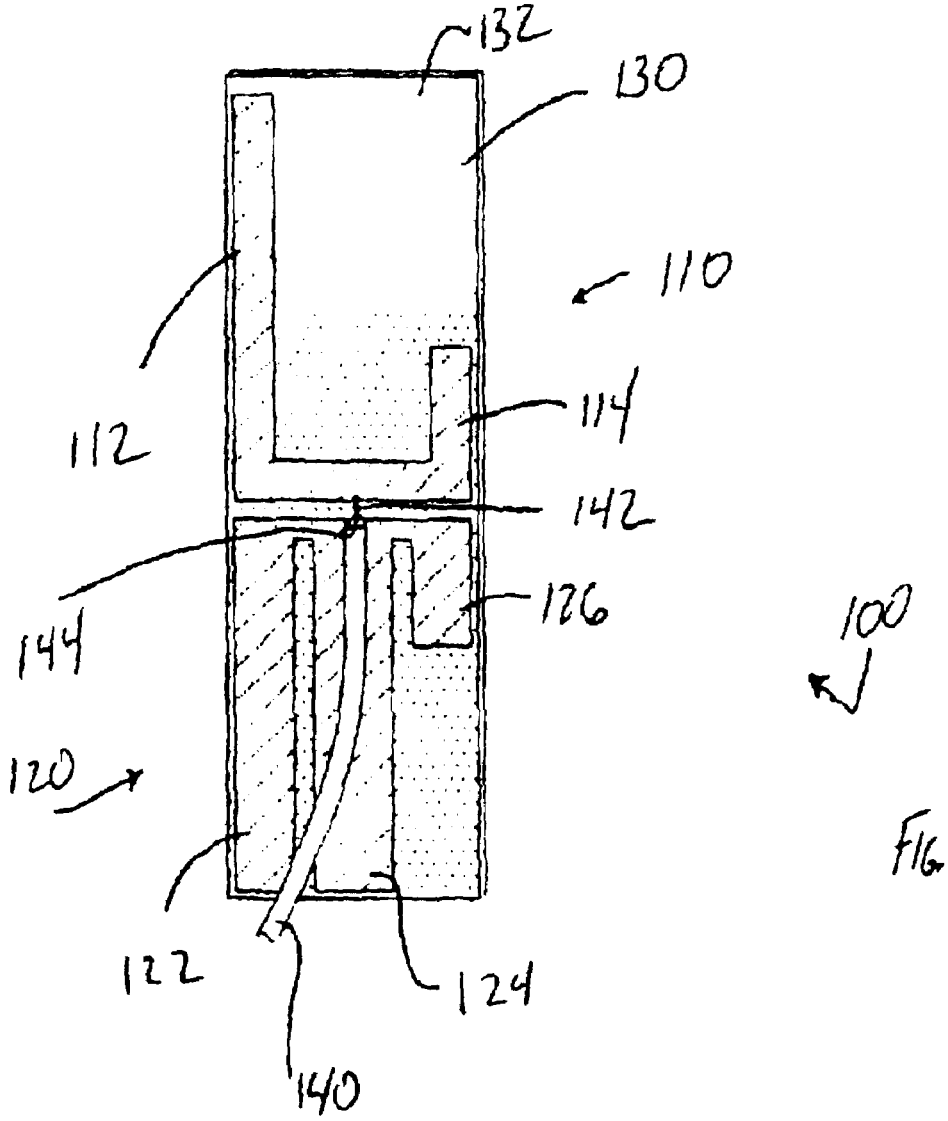
FIG. 1 is an illustrative block diagram of a printed circuit board omni directional antenna consistent with an embodiment of the present invention.

The present invention will be further explained with reference to the FIGS. Referring first to FIG. 1, a plan view of a printed circuit board omni directional antenna 100 is shown. Antenna 100 has a radiation portion 110 and a power feed portion 120 mounted on a substrate 130. Substrate 130 can be a number of different materials, but it has been found that non conductive printed circuit board material, such as, for example, sheldahl comclad PCB material, noryl plastic, or the like. It is envisioned that substrate 130 will be chosen for low loss and dielectric properties. A surface 132 of substrate 130 forms a plane. Radiation portion 110 and power feed portion 120 are mounted on substrate 130.

Radiation portion 110 comprises multiple conductive prongs to allow radiation portion 110 to operate at multiple bands. In this case, radiation portion has radiating element 112 and radiating element 114. As one of ordinary skill in the art will recognize on reading this disclosure, the operating bands can be tuned by varying the length L of radiating element 112, the length L1 of radiating element 114, or a combination thereof. While two radiating elements are shown, more or less are possible. Varying the thickness and dielectric constant of the substrate may also be used to tune the frequencies.

Power feed portion 120 comprises multiple conductive prongs similar to radiation portion 110. In this case, power feed portion 120 has power dissipation element 122, power dissipation element 124, and power dissipation element 126. Power dissipation elements 122, 124, and 126 may have identical lengths or varied lengths L2, L3, and L4 as shown. While three power dissipation elements are shown, more or less are possible.

Radiating elements 112 and 114, and power dissipation elements 122, 124, and 126 can be made of metallic material, such as, for example, copper, silver, gold, or the like. Further, radiating elements 112 and 114, and power dissipation elements 112, 124, and 126 can be made out of the same or different materials. Still further, radiating element 112 can be a different material than radiating element 114. Similarly, power dissipation elements 112, 124, and 126 can be made out of the same material, different material, or some combination thereof.

In this case, coaxial cable conductor 140 supplies power to antenna 100. While the power feed is shown as coaxial cable conductor 140, any type of power feed structure as is known in the art could be used. Coaxial cable conductor 140 has a center conductor 142 and an outer jacket 144. center conductor 142 is connected to radiation portion 110 to supply power to radiating elements 112 and 114. Outer jacket 144 is connected to power feed portion 120 to dissipate power from outer jacket 144. Optionally, coaxial cable conductor 140 can be attached to the length of power dissipation element 124 or directly to substrate 130 to provide some strength. Generally, the connections are accomplished using solder connections, but other types of connections are possible, such as, for example, snap connectors, press fit connections, or the like.

Figure 2:
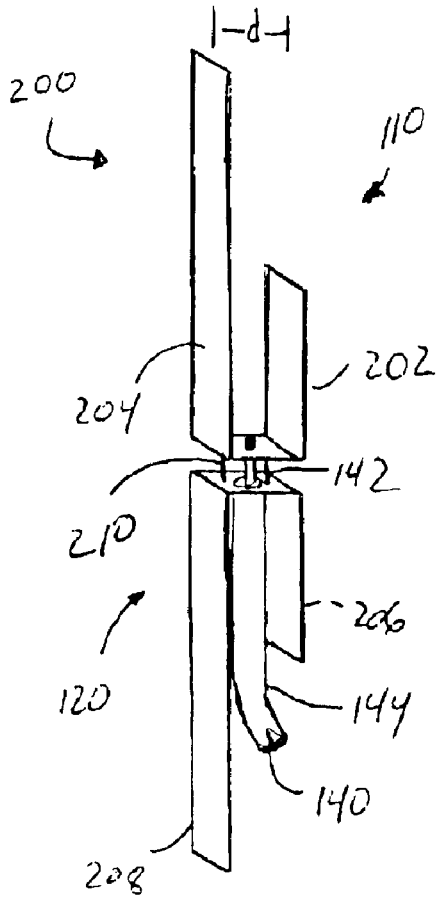
FIG. 2 is an illustrative block diagram of a printed circuit board omni directional antenna consistent with another embodiment of the present invention.

Another embodiment of the present invention is shown in FIG. 2. FIG. 2 shows a perspective view of an antenna 200 consistent with the present invention. Similar to antenna 100, antenna 200 comprises a radiation portion 110 and a power feed portion 120. Unlike antenna 100, antenna 200 does not comprise a substrate 130 and has a different configuration. In particular, radiation portion 110 includes radiating element 202 and radiating element 204 arranged in a face-to-face or a broadside configuration (in other words, the broadsides of each radiating element are in different and substantially parallel planes). Similarly, power feed portion 120 includes power dissipation elements 206 and 208 arranged in a broadside configuration. As can be appreciated, radiating elements 202 and 204 are separated by a distance d. Altering distance d can assist in tuning antenna 200. Radiating elements 202 and 204, may angle towards or away from each other while still in a face-to-face, but non-parallel configuration. A coaxial cable power feed 140 is attached to antenna 200. Coaxial cable power feed 140 includes a central conductor 142 and an outer jacket 144. Central conductor is attached to radiation portion 110, and outer jacket 144 is attached to power dissipation portion 120, similar to the above.

In this case, conductor 142 serves the additional purpose of coupling radiation portion 110 and power feed portion 120 together. Insulation is provided between portions 110 and 120 by outer jacket 144. Instead of using coaxial cable, non-conducting posts 210 can be used.

Figure 3:
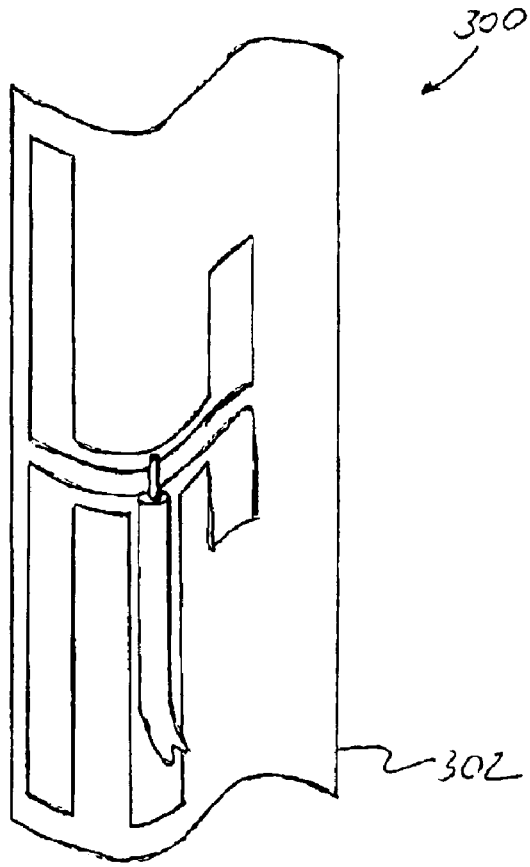
FIG. 3 is an illustrative block diagram of a printed circuit board omni directional antenna consistent with still another embodiment of the present invention.

Referring now to FIG. 3, an antenna 300 is shown consistent with another embodiment of the present invention. Antenna 300 has identical components to antenna 100, which components will not be re-described here. Unlike antenna 100, antenna 300 has a non-flat substrate 302. As shown, substrate 302 is a flexible substrate or a non-flexible substrate formed in an alternative shape, using fabrication technologies, such as, for example, injection molding. While shown as a wave shape, substrate 302 could take other configurations, such as, for example, a V shape, a arc shape, a U shape, a trough shape, an elliptical shape, or the like. In this configuration, the shape of substrate 302 will influence the frequency bands as well as the other tuning factors identified above.

While the invention has been particularly shown and described with reference to embodiments thereof, it will be understood by those skilled in the art that various other changes in the form and details may be made without departing from the spirit and scope of the invention.

The invention claimed is:

1. An antenna comprising:

a radiating portion;

the radiating portion comprising a plurality of radiating elements, the plurality of radiating elements producing a corresponding plurality of omni directional radiation patterns;

a power feed coupled to the radiating portion;

at least one power dissipation element coupled to the radiating portion; and a ground coupled to the at least one power dissipation element, such that the an impact of the power feed on the plurality of omni directional radiation patterns is reduced.

2. The antenna of claim 1, further comprising a substrate and the radiating portion resides on the substrate.

3. The antenna of claim 2, wherein the at least one power dissipation element resides on the substrate.

4. The antenna of claim 1, wherein the plurality of radiating elements have a corresponding plurality of lengths.

5. The antenna of claim 1, wherein the plurality of radiating elements reside in a plane.

6. The antenna of claim 1, wherein the plurality of radiating elements reside in parallel planes.

* * * * *

UNITED STATES PATENT AND TRADEMARK OFFICE

CERTIFICATE OF CORRECTION

PATENT NO. : 7,432,859 B2
APPLICATION NO. : 11/217760
DATED : October 7, 2008
INVENTOR(S) : Michael D. Zinanti and Shanmuganathan Suganthan It is certified that error appears in the above-identified patent and that said Letters Patent is hereby corrected as shown below:

On the Title Page Item (63) should read

Related US Application Data

(63) Continuation of application No. 10/708,520, filed Mar. 9, 2004

Signed and Sealed this

Second Day of December, 2008

JON W. DUDAS
*Director of the United States Patent and Trademark Office*